United States Patent [19]

Tassie

[11] 4,193,335

[45] Mar. 18, 1980

[54] GUN MISFIRE CONTROL

[75] Inventor: Douglas P. Tassie, St. George, Vt.

[73] Assignee: General Electric Company, Burlington, Vt.

[21] Appl. No.: 935,050

[22] Filed: Aug. 18, 1978

Related U.S. Application Data

[63] Continuation of Ser. No. 778,769, Mar. 17, 1977, abandoned.

[51] Int. Cl.[2] ..... F41D 7/02

[52] U.S. Cl. ..... 89/7; 89/11

[58] Field of Search ..... 89/7, 9, 11, 181

[56] References Cited

FOREIGN PATENT DOCUMENTS 534689 3/1922 France ..... 89/11

*Primary Examiner*—Stephen C. Bentley

*Attorney, Agent, or Firm*—Bailin L. Kuch

[57] ABSTRACT

A mechanism is provided to detect the occurrence of a misfire in an automatic gun and for thereupon halting, prior to the unlocking of the gun, the further operation of the gun; which is particularly adapted to liquid propellant guns having a rotating drum.

11 Claims, 4 Drawing Figures

PRESSURIZING GAS
PROPELLANT RESERVOIR
METERING CHAMBERS
BOLT
SPOOL VALVE ASSEMBLY
DRIVE MOTOR
DRUM CAM

TIMING DIAGRAM
LOCK
UNLOCK
FIRE
BOLT
INJECTION PISTON
VALVE
2 MSECS TYPICAL
t1 = 5.0 MSECS
t2 = 7.0 MSECS
t3 = 20.3 MSECS
t4 = 25.6 MSECS
t5 = 37.8 MSECS
t6 = 38.8 MSECS
t7 = 50.2 MSECS
t8 = 49.2 MSECS
t9 = 56.3 MSECS

GUN MISFIRE CONTROL

This application is a continuation of Ser. No. 778,769 filed Mar. 17, 1977, now abandoned.

The U.S. Government has rights in this invention pursuant to Contract No. N00123-75-C-0670 awarded by the Department of Defense.

BACKGROUND OF THE INVENTION

1. Field of the Invention.

This invention relates to a mechanism for detecting the occurrence of a misfire in an automatic gun and for thereupon halting the further operation of such gun.

2. Prior Art

In a conventional, single barrel, selfpowered, automatic gun firing cased ammunition, when a misfire occurs, the gun stops in its operating cycle, sometimes after having unlocked the bolt. If the misfire is a true dud, the operator usually merely cycles the gun to eject the dud and to chamber and lock a fresh round. If the misfire is a hangfire and if the bolt is unlocked when the hangfire occurs, it may cause a wrecked gun.

In a conventional, single barrel, externally powered, automatic gun firing cased ammunition, when a misfire occurs, the gun continues its operating cycle. If the misfire is a true dud, the gun will eject the dud, and chamber and lock a fresh round. If the misfire is a hangfire and if the bolt is unlocked when the hangfire occurs, it will cause a wrecked gun.

Similar problems occur in multibarreled guns, and in guns firing caseless ammunition, whether using solid or liquid propellant.

SUMMARY OF THE INVENTION

It is an object of this invention to provide a mechanism to detect the occurrence of a misfire in an automatic gun and for thereupon positively halting, prior to the unlocking of the gun, the further operation of the gun.

It is a further object to provide such a mechanism which is particularly adapted to liquid propellant guns having a rotating drum.

A feature of this invention is the provision of a cam which is coupled to the gun and which rotates in synchronism with the operating cycle of the gun, pressure sensitive means for detecting the firing of a round and in the absence of such firing, for positively halting rotation of the cam after the time for firing and before the time for unlocking the gun bolt.

BRIEF DESCRIPTION OF THE DRAWING

These and other objects, advantages and features of the invention will be apparent from the following specifications thereof taken in conjunction with the accompanying drawing in which.

DESCRIPTION OF THE INVENTION

Figures 1, 2:
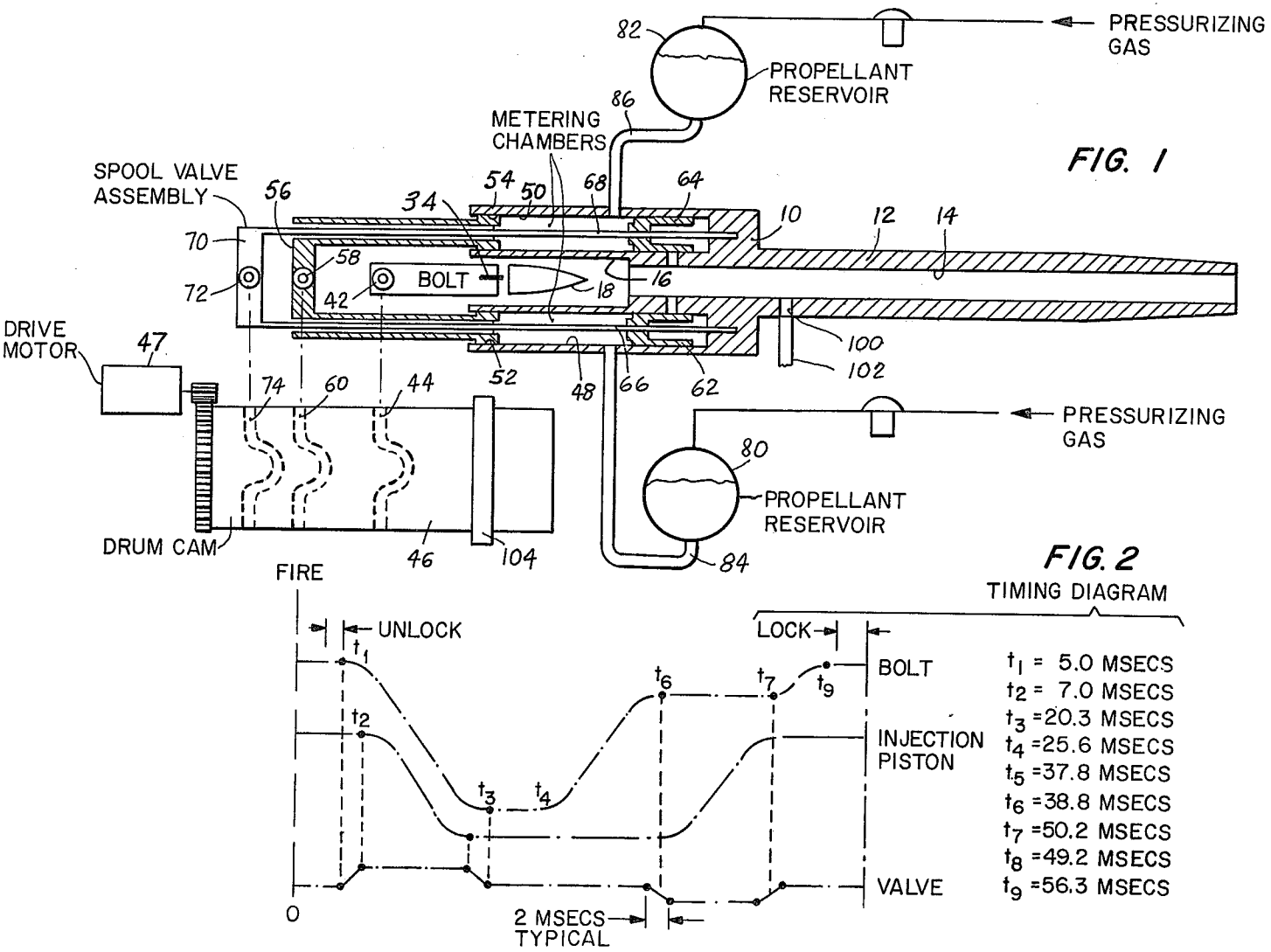
FIG. 1 is schematic of an exemplary liquid propellant gun system as disclosed in U.S. Pat. No. 3,763,739.
FIG. 2 is a timing diagram of the gun of FIG. 1.
Figure 3:
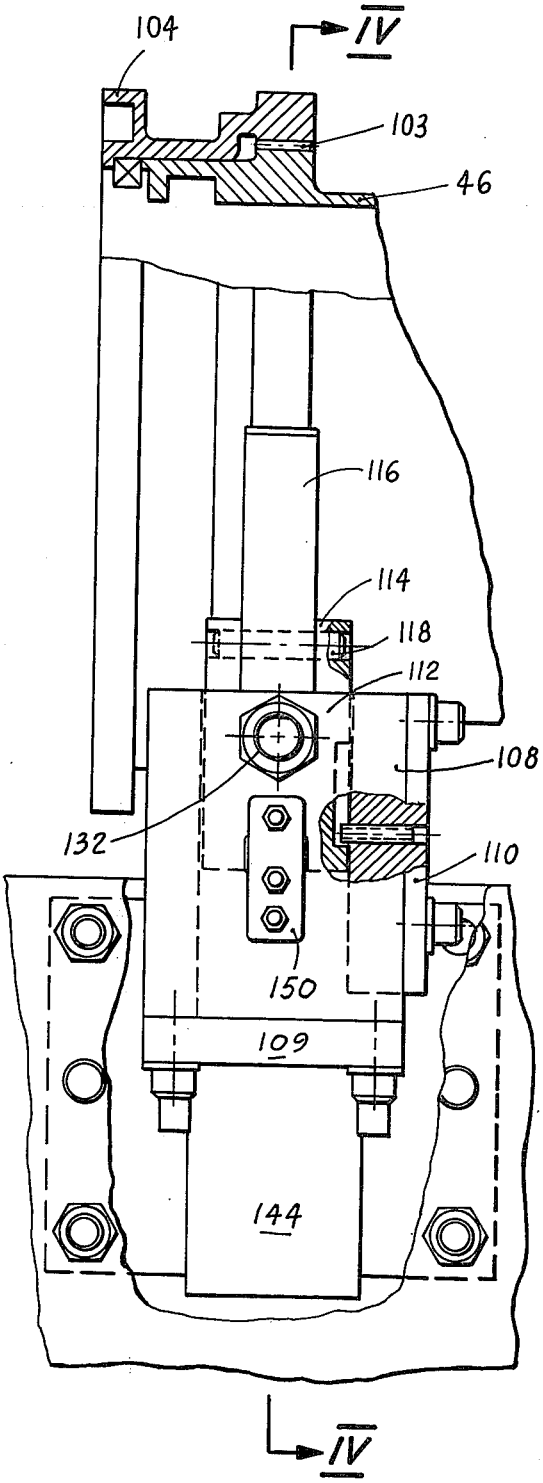
FIG. 3 is a side view in cross-section taken along the plane III—III of FIG. 4.

The gun system shown in FIG. 1 is disclosed in greater detail in U.S. Pat. No. 3,763,739, issued to D. P. Tassie on Oct. 9, 1973. The gun includes a receiver 10, in which is fixed a barrel 12 having a bore 14. The aft end of the bore is chambered at 16 to provide a combustion chamber and to receive a projectile 18 having an O-ring seal and a rotating band. The receiver includes a bolt body having a bolt head having a central bore in which an electrode 34 is fixed in a dielectric sleeve, and appropriate seal rings. The bolt has a transversely projecting roller 42 which rides in a cam slot 44 in a drum cam 46, and which cam is driven by a motor 47. The receiver includes two additional longitudinal bores 48 and 50 in which two pistons 52 and 54 respectively slide. The two pistons are coupled aft by a yoke 56 which has a transversely projecting roller 58 which rides in a cam slot 60 in the cam 46. Two spools 62 and 64 respectively slide in the forward portions of the bores 48 and 50. The spools are respectively fixed to two rods 66 and 68 which are coupled aft by a yoke 70 which has a transversely projecting roller 72 which rides in a cam slot 74 in the cam 46. Two propellant reservoirs 80 and 82 are pressurized by suitable supplies of gas and are respectively coupled by conduits 84 and 86 to the bores 48 and 50. The supply of electrical energy to the electrode for the purpose of igniting the liquid propellant may also be controlled by the drum cam 46 by means of a suitable cam and switch, not shown.

A gas port 100 is provided in the gun barrel 12 forward of the forcing cone and the start of the rifling. Combustion gas pressure is available at this port 100 only if the round has fired and its projectile has moved forward past this port. A conduit 102 is fitted to this port.

A stop cam 104 is fixed to the drum cam 46. The stop cam is substantially annular and may be fixed to the drum cam by an annular row of splines 103.

Figure 4:
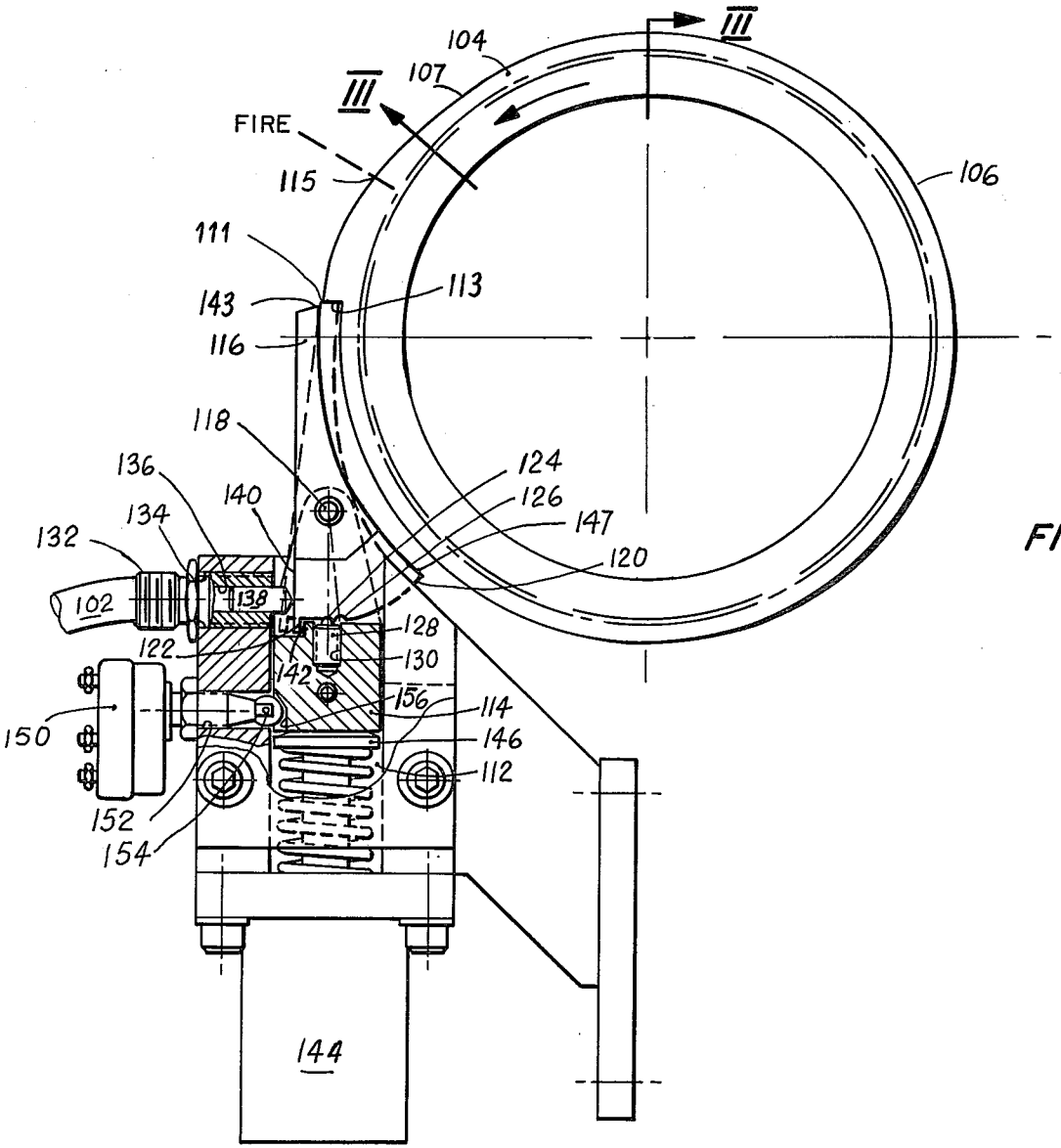
FIG. 4 is an end view in cross-section of an embodiment of this invention in combination with the gun of FIG. 1 taken along plane IV—IV of FIG. 3.

A stop mechanism 108 is fixed to the gun housing for cooperation with the stop cam 104. The mechanism includes a housing 109, which as a side cover 110, and provides a rectangular cavity 112 open at the top, in which is slid a bifurcated yoke 114. A pawl stop 116 is pivotably mounted between the bifurcations by a dowel pin 118. The base 120 of the pawl stop has a projecting detent 122 and two detent recesses 124 and 126. A spring loaded ball plunger 128 is disposed in a bore 130 in the base of the yoke and is adapted to engage one or the other of recesses 124 and 126. The conduit 102 terminates in a fitting 132 which is threaded into a bore 134 in the housing. The fitting has a longitudinal bore 136 in which is disposed a piston 138. The distal end of the piston 138 abuts the lower end 140 of the pawl stop 116. Thus gas pressure in the conduit 102 will project the piston 138 to swing the pawl stop counter-clockwise (as seen in FIG. 4) until the detent 122 abuts a shoulder 142 on the yoke, and the ball plunger 128 enters the detent recess 124 to hold the pawl stop in that position. A shock block 144 is fixed to the base of the housing and has a spring load plunger 146 fixed to a hydraulic damper and supports the yoke 114 in the cavity 112. A microswitch 150 is threaded into a bore 152 in the housing and has a spring loaded activator with a cam follower 154 extending into the cavity and adapted to abut a cam surface 156 on the base of the yoke. Should the yoke slide down in the cavity against the urging of the plunger 146, the ramp portion of the cam surface 156 will ride against the cam follower 154 and actuate the microswitch 150.

The drum cam 104 has a peripheral cam surface 106 which is of constant radius, except at a point 107 whereat it starts to progressively rise until a high point 111 whereat it abruptly falls back to the constant radius, providing a radial shoulder 113. The drum cam 104 rotates counter-clockwise (as seen in FIG. 4).

In normal operation, the cam rotates counter-clockwise, and shortly after the high point 111 passes its angular orientation 115 at which time the gun fires, gas under pressure exits the gun barrel bore 100 to enter the conduit 102 to project the piston 138, to rotate the pawl stop 116 counter-clockwise so that the tip 143 of the pawl stop is swung out of the path of the shoulder 113, until the detent 122 engages the shoulder 142 and the ball plunger 128 engages the recess 124. As the cam continues its rotation, the high point 111 strikes the surface 147 of the pawl stop 116 and swings the pawl stop clockwise until the tip 143 of the pawl stop rides on the constant radius surface of the cam and the ball plunger 128 engages the recess 126. The cycle of operation just described is repeated for each gun cycle.

However, in the event of a misfire, no gas pressure is provided in the conduit 102 and the plunger is not projected to clear the pawl stop. The tip 143 of the pawl stop engages the shoulder 113 to halt further rotation of the cam. Deceleration is provided by shoulder 113 driving the pawl stop 116 and the yoke 114 against the urging of the spring loaded plunger 146 of the shock block. As the yoke descends, it actuates the microswitch to cut off power to the drive motor. The gun cycle is thus halted before the unlocking of the gun bolt occurs.

What is claimed is:

1. An automatic gun having an operating cycle and comprising:

a gun barrel having a gun bore and a projectile receiving chamber;

first means for closing and locking said chamber;

second means operating in synchronism with and controlling the operating cycle of said gun, including a first cam rotating in synchronism with the operating cycle of said gun;

third means coupled to said gun barrel and to said second means for detecting the firing out of a projectile from said chamber, and in the absence of said firing, for positively halting operation of said second means after the time for firing and before the time for unlocking said chamber by said first means, including detent means having a first position whereat it clears said first cam, and a second position whereat it halts said first cam at a first predetermined angular orientation of said first cam; and said first cam including additional means to cyclically set said detent means to said second position at a second predetermined orientation of said first cam.

2. A gun according to claim 1 wherein:

said third means includes detector means coupled to and between said gun bore and said detent means for detecting the presence of combustion gas in said gun bore and for thereup setting said detent means to said first position thereof.

3. A gun according to claim 2 wherein:

said additional means of said first cam functions each gun operating cycle before the time for firing; and said detector means functions, if at all, after the time for firing and before the time for unlocking said chamber.

4. A gun according to claim 3 wherein:

said detector means includes a conduit coupled into said gun bore forward of said chamber to convey combustion gas under pressure to said detent means.

5. A gun according to claim 4 wherein:

said first cam includes a rotating shoulder; and said detent means includes a pivoting dog adapted to be swung into and out of the orbit of said shoulder.

6. An automatic gun having an operating cycle including load, lock, fire and unlock operations in sequence;

a gun barrel having a gun bore and a projectile and propellant receiving chamber;

first means for closing and locking said chamber;

second means for firing propellant disposed within said chamber;

third means for operating said first means to close and lock said chamber, for subsequently operating said second means for firing any propellant disposed within said chamber, and for yet subsequently operating said first means to unlock and open said chamber, including a first cam rotating in synchronism with the operating cycle of said gun and controlling said operating cycle;

fourth means coupled to said gun barrel and to said third means for detecting the firing of propellant within said chamber and in the absence of such detection, for positively halting the operation of said third means after the time for firing by said second means and before the time for unlocking by said first means, including detent means having a first position whereat it clears said first cam, and a second position whereat it positively halts said first cam at a first predetermined angular orientation of said first cam;

and said first cam including additional means to cyclically set said detent means to said second position at a second predetermined orientation of said first cam.

7. A gun according to claim 6 wherein:

said fourth means includes detector means coupled to and between said gun bore and said detent means for detecting the presence of combustion gas in said gun bore and for thereup setting said detent means to said first position thereof.

8. A gun according to claim 7 wherein:

said additional means of said first cam functions each gun operating cycle before the time for firing; and said detector means functions, if at all, after the time for firing and before the time for unlocking said chamber.

9. A gun according to claim 8 wherein:

said detector means includes a conduit coupled into said gun bore forward of said chamber to convey combustion gas under pressure to said detent means.

10. A gun according to claim 9 wherein:

said first cam includes a rotating shoulder; and said detent means includes a pivoting dog adapted to be swung into and out of the orbit of said shoulder.

11. An automatic gun having an operating cycle including load, lock, fire and unlock operations in sequence;

a gun barrel having a gun bore and a projectile and propellant receiving chamber;

first means for closing and locking said chamber;

second means for firing propellant disposed within said chamber and for generating gas pressure in said chamber;

third means for operating said first means to close and lock said chamber, for subsequently operating said second means for firing any propellant disposed within said chamber, and for yet subsequently operating said first means to unlock and open said chamber;

fourth means coupled to said gun barrel and to said third means for detecting the generation of gas pressure in said chamber and in the absence of such detection, for positively halting the operation of said third means after the time for firing by said second means and before the time for unlocking by said first means;

said third means including a first cam rotating in synchronism with the operating cycle of said gun and controlling said operating cycle; and said fourth means including detent means having a first position whereat it clears said first cam, and a second position whereat it positively halts said first cam at a first predetermined angular orientation of said first cam; and said first cam means including additional means to cyclically set said detent means to said second position at a second predetermined orientation of said first cam.

* * * * *